US006887154B1

(12) United States Patent
Luciano, Jr. et al.

(10) Patent No.: US 6,887,154 B1
(45) Date of Patent: May 3, 2005

(54) SHARED PROGRESSIVE GAMING SYSTEM AND METHOD

(75) Inventors: Robert Anthony Luciano, Jr., Reno, NV (US); Loren Travis Nelson, Reno, NV (US)

(73) Assignee: Sierra Design Group, Las Vegas, NV (US)

( * ) Notice: Subject to any disclaimer, the term of this patent is extended or adjusted under 35 U.S.C. 154(b) by 116 days.

(21) Appl. No.: 10/162,819

(22) Filed: Jun. 4, 2002

(51) Int. Cl.[7] ..... A63F 9/24
(52) U.S. Cl. ..... 463/26; 463/42
(58) Field of Search ..... 463/12–13, 16–22, 463/25–28, 40–42; 273/138.1, 138.2, 139, 143 R

(56) References Cited

U.S. PATENT DOCUMENTS 5,275,400 A 1/1994 Weingardt
5,564,700 A 10/1996 Celona
6,077,162 A 6/2000 Weiss
6,089,980 A 7/2000 Gauselmann
6,146,273 A 11/2000 Olsen
6,206,782 B1 * 3/2001 Walker et al. ..... 463/25
6,319,125 B1 * 11/2001 Acres ..... 463/25
6,575,832 B1 * 6/2003 Manfredi et al. ..... 463/25

* cited by examiner

*Primary Examiner*—Mark Sager
(74) *Attorney, Agent, or Firm*—Russ F. Marsden

(57) ABSTRACT

A progressive system (local and wide) where a primary and secondary progressive meter is maintained is disclosed. When a progressive win event occurs, there are two payouts: the first payout (defined by the primary meter) is paid to the player triggering the progressive payout event; the second payout (defined by the secondary meter) is paid to other players (or game devices) having "active" or "enrolled" status at the time of the primary payout event. The present invention provides a method for automating the "shared" win, including means for readily determining "active" players. A countdown meter may be used to enable the player a sufficient amount of time to continue play and be considered "active." Additionally display meters may be used to indicate the status of the player or to warn the player of an imminent change in status. The progressive prizes may be funded using traditional methods (e.g., percentage of wagers, marketing budget). The progressive prizes may also be funded using expired prizes which have expired or lapsed.

18 Claims, 7 Drawing Sheets

Status: Active

Place a wager to remain active....

Time left: 5 seconds

*Fig. 6A*

Status: Inactive

Place a wager to become active....

*Fig. 6B*

SHARED PROGRESSIVE GAMING SYSTEM AND METHOD

BACKGROUND OF THE INVENTION

1. Field of the Invention

This invention pertains generally to progressive systems for gaming. More particularly, the invention relates to a shared progressive gaming system and method which allows a plurality of players to share a progressive prize.

2. The Prior Art

Progressive systems for gaming environments such as casinos are known. A typical progressive system arrangement includes a plurality of gaming devices, such as slot machines, video poker machines, video keno machines, video lottery machines, each linked for communication with a central progressive controller. A wager is made to play the game associated with the gaming devices. For each wager made at the gaming devices, a portion is used to fund a progressive prize which is maintained and accumulated by the progressive controller. The progressive prize is then awarded to a player upon the occurrence of a triggering win event, either determined pursuant to play on the gaming device or by some other criteria, such as according to a random determination by the progressive controller. Since the triggering win event for awarding the progressive prize occurs infrequently, the progressive prize generally accumulates to a large sum. As a result, players are attracted to playing the gaming devices in order to win the large progressive prize, thereby increasing game play and therefore overall revenue for the casino operator.

Efforts to improve this general scheme for paying a progressive prize have been attempted to further increase player interest. An example improvement arrangement is disclosed in U.S. Pat. No. 5,564,700 to Celona. In the Celona progressive method, a progressive jackpot is paid proportionally to eligible players at each of the linked gaming machines. The eligibility of players to share in the progressive jackpot may be conditioned upon "playing a maximum bet" within a "predetermined time interval before the progressive jackpot-winning outcome occurs." Payment of the progressive jackpot may be divided equally among all eligible players, or may be paid proportionally (e.g., the player at the machine that generated the progressive jackpot-winning outcome may receive a greater proportion (such as half) of the jackpot, or the proportion of the jackpot paid to each of the players may be adjusted in accordance with the contribution of each machine to the progressive jackpot sum).

While the payout method of Celona may foster increased participation and play from players, there are several drawbacks. First, the motivation for winning a large progressive jackpot is diminished, even where as in Celona "the player at the machine that generated the progressive jackpot-winning outcome may receive a greater proportion." This diminished motivation arises from the fact that the player perceives that he or she will have to "share" the displayed or advertised jackpot with other players. Players prefer playing for a large life-changing jackpot, and the sharing of the jackpot, even where the player receives a greater proportion reduces the overall player interest.

Additionally, the incentive for remaining eligible to share in the jackpot is inadequate in the Celona implementation. For example, one way to determine eligibility is for the central controller to determine the interval between the time of play initiation on the gaming device and the time of the jackpot-winning outcome; if the time interval is less than the predetermine interval for jackpot eligibility, then the player qualifies to share in the jackpot. However, as disclosed, this calculation is carried out after the jackpot-winning outcome has already occurred. There are no indicators or cues provided to the player to encourage the player to remain eligible prior to the jackpot-winning outcome. Absent such indicators and cues, players are less informed and are less likely to satisfy the requirement of remaining eligible. This problem results in decreased play and lost revenues for the operator.

Accordingly, there remains a need for further increased player participation in progressive payout arrangements. The present invention satisfies these needs, as well as others, and generally overcomes the deficiencies found in the background art.

BRIEF DESCRIPTION OF THE INVENTION

The present invention is a system and method for providing an enhanced shared progressive system and method, suitable for use in gaming establishments such as casinos. The progressive system may be used in a wide area environment and/or a local area environment.

In general, the progressive system comprises at least one progressive controller coupled for communication with one or more gaming devices (or player terminals) via a networking connection. A finding module operating in the progressive controller maintains a primary progressive prize and a secondary progressive prize, the progressive prizes displayed normally by the progressive controller using a progressive display meter or other display means. In operation, the funding module funds the progressive prizes which are awarded as described in greater detail further below. Various funding arrangements are suitable for use in funding the prizes, including using a percentage of wagers placed on the gaming devices, or using a percentage of the pay table awards for paying prices on the gaming devices, for example.

An enrollment module operating in the gaming device carries out several operations as described in more detail further below. In general, the enrollment module monitors game events on the gaming device and further communicates with the funding module to indicate the "active" or "inactive" status of the player playing the gaming device based on the determined game events. According to one aspect of the present invention, an "active" status player may be eligible to share in a one or more secondary progressive prizes. Various strategies may be used to determine the status of the player to encourage play on the gaming device, such as based on the average play over a period of time, or based on a requirement that the player perform some action within a period of time from the end of the previous game, for example.

The enrollment module is further coupled for communication with a status indicator. The status indicator may comprise various forms such as mechanical indicators or dials and/or electronic display indicators (e.g., video display, LED, LCD), or may comprise a portion of the base game display. The enrollment module displays the status of player (i.e., "active" or "inactive") through the status indicator. If the player's status is "active," the status indicator may further indicate how long the player's status will remain "active' before becoming "inactive" (e.g., a countdown indicator or dial). Other text messages may be further be displayed to the player pursuant to this arrangement such as warnings, for example.

In operation, the system awards the primary and secondary progressive prizes pursuant to game events occurring on the gaming devices. In particular, the funding module monitors the communication network for specific progressive award triggering events which when triggered by a player, entitling the player to the primary progressive prize. Additionally, players who have an "active" status at the time of the progressive award triggering event are entitled to share in the secondary progressive prize. The share of the secondary prize may be distributed to players using various strategies including an equal share, or a proportional share based on one or more criteria (e.g., amount bet, average bet, player tracking points).

According to the present invention, players seeking large progressive wins are drawn to the system of the present invention because a large primary progressive prize may be won without sharing with other players; and at the same time players seeking to benefit from regular or active play are also drawn to the system because one or more shared secondary progressive prizes may be dispensed to the "active" player even if another player has won the large primary prize. Additionally, the enrollment module and status indicator provides a visible means for encouraging the player to remain active to qualify for the shared secondary prize. Under this arrangement, the present invention overcomes many of disadvantages associated with the prior art.

According to another embodiment of the invention, the system further provides a prize expiration and reissue module executed by the central progressive controller or other central server device. According to this embodiment, the player may be awarded one or more prizes, which require redemption. Such prizes may be in the form of points, coupons, game pieces, for example and may require the player to accumulate or collect a certain amount or arrangement of points, coupons, game pieces, etc. The prizes may be awarded to a player using a variety of means, such as via a printed ticket or stored electronically using an account server, for example. In some cases, a player may not redeem his or her prize. In other cases, the player may not accumulate sufficient points, coupons, credits, etc. to enable the player to qualify for a prize, in which case, the points, coupons, credits, etc. may expire after a lapse period. Various other events may cause, the prizes, points, etc. to expire. The prize expiration and reissue module of the present invention provides a means for tracking these prizes to determine expiration, and upon certain conditions re-issuance of the expired prizes. According to one embodiment, the expired prizes are maintained and accumulated by the prize expiration and reissue module and awarded to players of the system upon the occurrences certain events. The prize expiration and reissue module may accumulate and award the expired prizes as a "secondary progressive prize" which are awarded to and shared by active players as described above. This arrangement provides an enhanced funding scheme for funding prizes for the secondary progressive prize. A similar arrangement may be used to fund the primary progressive prize.

The invention further relates to machine readable media on which are stored embodiments of the present invention. It is contemplated that any media suitable for retrieving instructions is within the scope of the present invention. By way of example, such media may take the form of magnetic, optical, or semiconductor media. The invention also relates to data structures that contain embodiments of the present invention, and to the transmission of data structures containing embodiments of the present invention.

Further advantages of the invention will be brought out in the following portions of the specification, wherein the detailed description is for the purpose of fully disclosing the preferred embodiment of the invention without placing limitations thereon.

BRIEF DESCRIPTION OF THE DRAWINGS

The present invention will be more fully understood by reference to the following drawings, which are for illustrative purposes only.

FIGS. 6A, 6B, 7A, 7B, and 7C depict example status display indicators suitable for use with the present invention.

DETAILED DESCRIPTION OF THE PREFERRED EMBODIMENTS

Persons of ordinary skill in the art will realize that the following description of the present invention is illustrative only and not in any way limiting. Other embodiments of the invention will readily suggest themselves to such skilled persons having the benefit of this disclosure.

Figure 1:
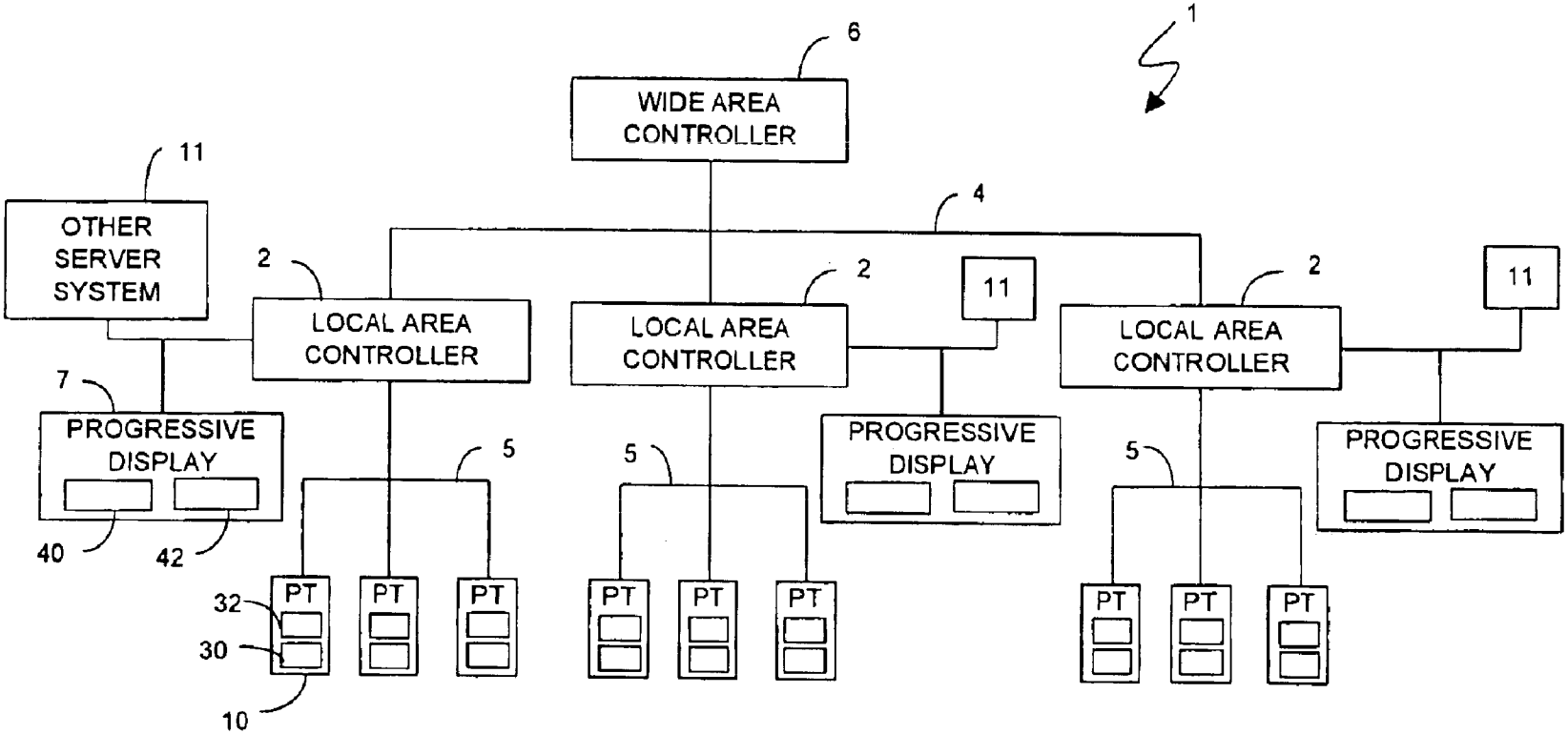
FIG. 1 is a functional block diagram depicting an example progressive system in accordance with the present invention.

Referring first to FIG. 1, there is generally shown an illustrative progressive system 1 suitable for use with the present invention. The system 1 comprises a plurality of local area controllers 2, each operating in a local network 5, and plurality of gaming devices (or player terminals) 10, each operatively coupled for communication with a respective local area controller 2 via respective local network 5.

A progressive display 7 is provided on each local network 5 and is operatively coupled to the local area controller 2 for display of a primary jackpot progressive prize 40 and at least one secondary jackpot progressive prize 42. As described in more detail below, the primary jackpot progressive prize 40 is awarded to the player triggering the progressive payout event. The secondary jackpot progressive prize 42 is awarded to other eligible players as described more filly below. The prizes 42 and 40 are normally funded by play of the gaming devices 10 (e.g., a percentage of wagers, or from the pay table) and are generally displayed to the users via progressive display 7. Other means for funding the progressive prize are also suitable for use with the invention, such as funding the progressive prize through a marketing budget, for example. As described in another embodiment below, the secondary prize 42 may also be funded using "expired" awards (e.g., expired points, coupons, etc.), rather than through wagers placed at the gaming devices 10.

Each local area controller 2 may further be coupled to a wide area controller 6 via a suitable communication connection (e.g., wide area network, frame relay). Under such an arrangement, each of the gaming devices 10 in each network 5 contribute to the primary jackpot progressive prize 40 and the secondary jackpot progressive prize 42, which are each displayed at the local networks 5. Each local network 5 may reside at a separate site or casino location from the other local network, thereby allowing broader participation among players visiting the various sites or locations. Additionally, with greater participation, the jackpots prizes 40, 42 accumulate to higher totals at a faster rate.

Other server systems 11 may also be provided for each network 5. Other server systems 11 may include player tracking systems or accounting systems, for example. In accordance with one embodiment of the present invention, the other server systems 11 may also include a prize server system executing a prize expiration and reissue module which is configured to track expirable and/or expired prizes, which may be used to fund the progressive awards, as described more fully below.

Figure 2:
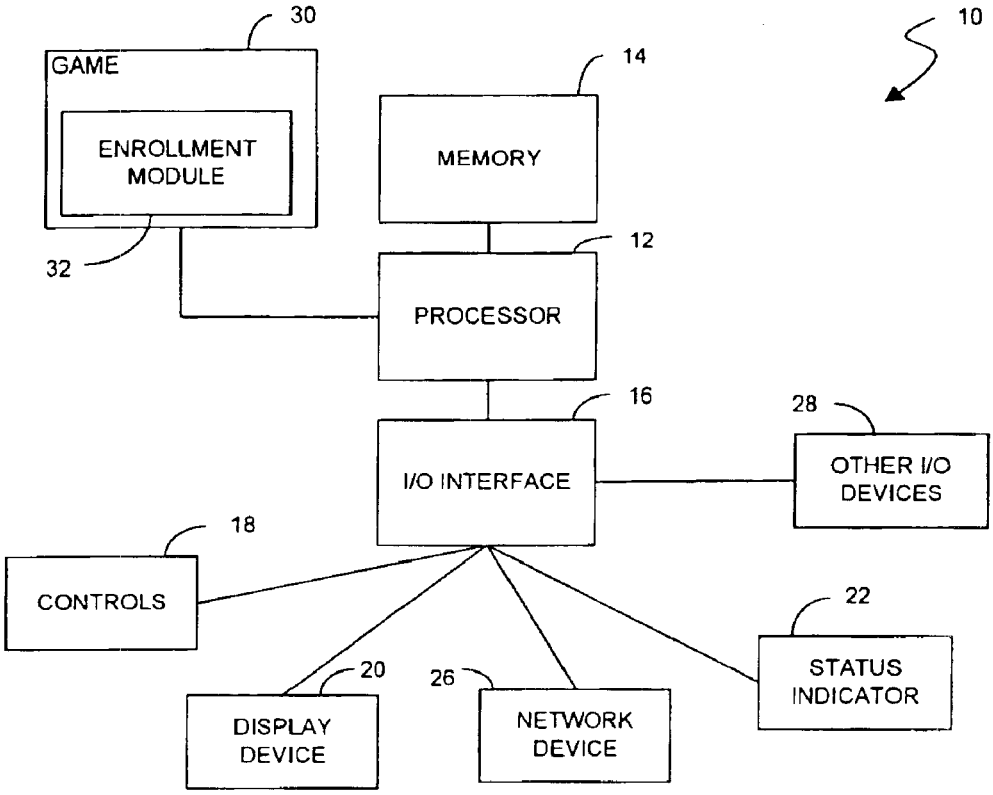
FIG. 2 is a functional block diagram depicting a gaming device in accordance with the present invention.

Referring next to FIG. 2, there is generally shown a block diagram of an example gaming device 10 having a processor 12 coupled to a memory 14 suitable executing an enrollment module. The enrollment module 32 is generally provided as part of the instructions/programming provided with the game 30, which is played on the gaming device 10. The game 30 generally includes a primary (or base) game and may also include a secondary (or bonus) game. The game 30 and the enrollment module 32 are normally provided as software instructions stored on a memory (such as an EPROM or other storage) which is read and executed by the processor 12 during operation. The operation of the enrollment module 32 is described more fully below.

The gaming device 10 is generally described herein as a conventional gamine machine, such as a slot machine, poker machine, keno machine, bingo machine, video lottery machine, and other like gaming device, although the enrollment module 32 is equally suitable for use with "table" games, where the functions are carried out in conjunction with management by a table attendant or dealer.

Referring again to FIG. 2, the gaming device 10 further comprises an input/output (I/O) interface 16 which is coupled for communication with the processor 12. The I/O interface 16 allows a player to interact (i.e., provide input controls and receive output signals) with the game 30 and the processes of the enrollment module 32 executed by the processor 12 via a plurality of devices, generally designated as controls 18, display device 20, status indicator 22, network interface device 26, and other I/O devices 28 each of which are operatively coupled for communication to the I/O interface 16.

The controls 18 generally comprise input buttons, switches, touch-screen controls, and/or other input controls to allow a player to provide game input to the gaming device 10 such as player options, selections, game commands, among others. The display device 20 generally comprises a monitor or other video output device (e.g., LCD panel) for communicating game output information to the player. The status indicator 22 as described more fully below provides a display or indicator to the player and indicates status information to the player (e.g., player status, active status time remaining). The network device 26 generally comprises a communication device such as a network card or serial device for communicating with other network devices (e.g., back-end servers) via a network which is generally coupled to the network device 26. Other I/O devices 28 may also be provided, such as speakers, lights, alarms, etc.

The enrollment module 32 which is executed by the processor 12 carries out several operations to track and maintain the player's status. As noted above, various criteria may be used to define a player's eligibility for sharing in the secondary progressive prize 42. For example, a player may be required to place a wager (or specific type of wager such as "maximum bet") within a certain time period after completing the previous game. The enrollment module 32 monitors the gaming device 10 to determine whether the requirements for eligibility have been met. The enrollment module 32 also indicates the player's status through the status indicator 22. The enrollment module 32 further notifies the player when the player's status is about to expire or change from "active" to "inactive." Various warnings using visual display indicators (status indicator 22) and/or sound output devices (e.g., speakers) may be used to alert the user. Example display indicators are described below in conjunction with FIG. 6 and FIG. 7.

Figure 3:
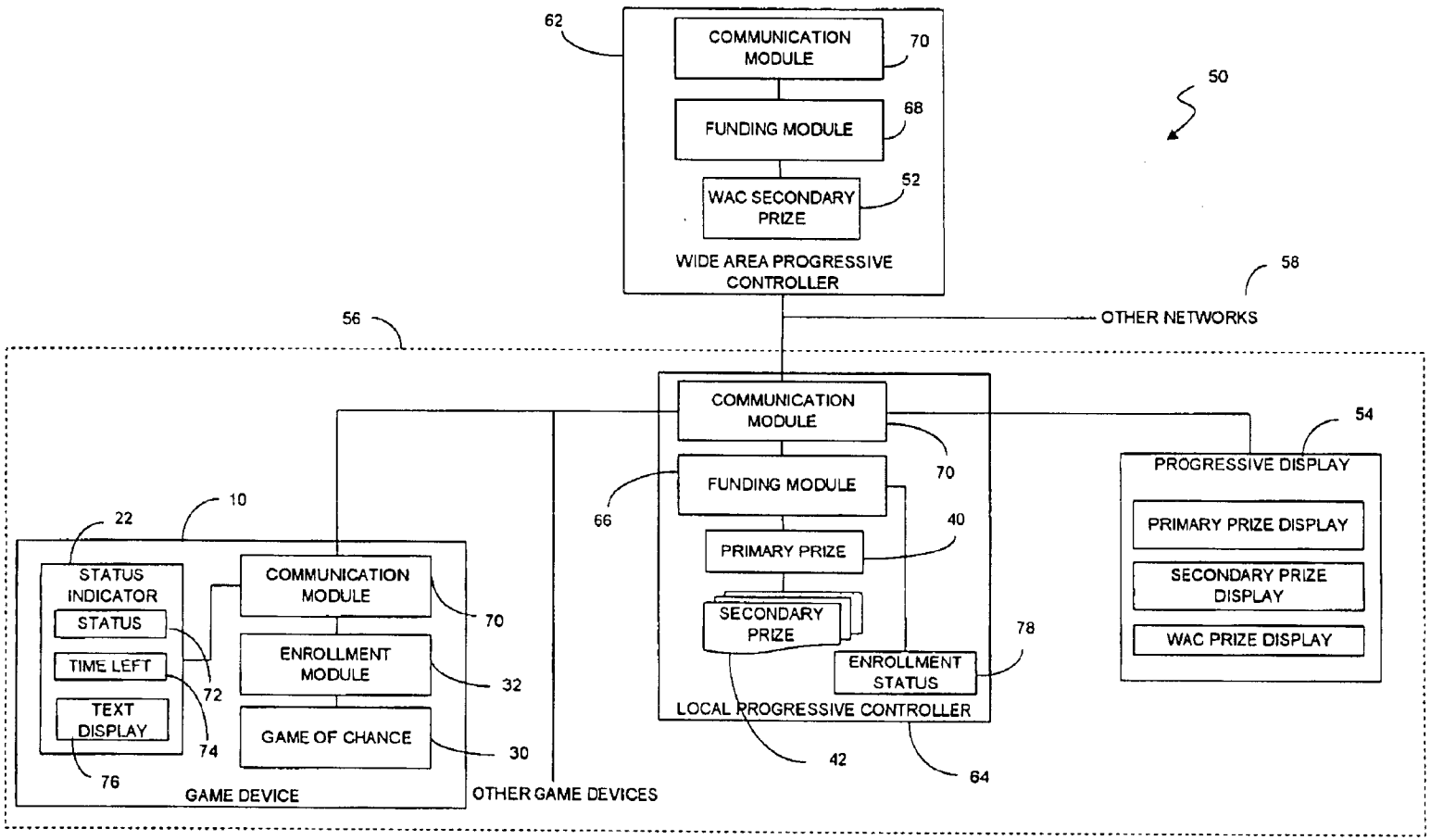
FIG. 3 is a functional block diagram depicting a second example progressive system in accordance with the present invention.

Referring now to FIG. 3, another illustrative system 50 is shown including a wide area progressive prize 52. Under this arrangement, three progressive prizes are made available at each local casino network 56: a primary prize 40, at least one secondary prize 42, and at least one "Wide Area" (WAC) Prize 52. A progressive display 54 at the local casino 56 may be used to display the amounts of each of the progressive prizes. The local casino networks 56 (and other local casino networks 58) are coupled for communication with a central wide area progressive controller 62, through a network communication system, such as a wide area network (WAN) system. A communication module 70 operating within each of the wide area controller 62, the local controllers 64, and the gaming devices 10 enable network communication between the devices of the system. In general, the communication module 70 comprises suitable network hardware (e.g., network interface cards, cabling) and software (e.g., communication software, protocols, network drivers) to enable communication between data processing devices.

At the local level 56, the primary prize 40 and secondary prize 42 may be funded using a progressive funding model as described above (e.g., using a percentage of wagers from gaming devices from the local network 56, marketing funds, etc.) by a funding, module 66 executed by a local progressive controller 64. At the wide area level, the WAC prize 52 may be funded using a similar funding scheme (e.g., using a percentage of wagers made from gaming devices from all of the local networks 56, 58) by the funding module 68 executed by the wide area progressive controller. The WAC prize 52 may be defined as a primary prize in which case it is won by the player triggering the progressive win event; or it may be defined as a secondary prize in which case it is shared by all active players (from all networks 56, 58) the occurrence of a progressive win event. In other embodiments, the system 50 may define two WAC prizes, one of which is a primary prize, the other which is a secondary prize.

As depicted in FIG. 3, the gaming devices 10 include a status indicator 22 to display the status of the player. In the example status indicator 22 of FIG. 3, the status indicator comprises a status display 72, a time left display 74, and a text display 76. The status display 72 indicates either a status of "active" or "inactive." The time left display 74 displays the time left (e.g., in seconds) before the player's status changes from "active" to "inactive." The text display 76 may be used to indicate text messages to the player, such as a warning message that the player's active status is expiring, for example. The game device 10 communicates with the local controller 64 to communicate, among other things, the player's status. This status information is maintained by the local controller 64 in an enrollment status database 78. Under this arrangement, the status of the player can be ascertained and verified by the gaming device 10 and/or the local controller 64, either together in independent of the other.

Referring next to FIG. 6A and FIG. 6B, example status indicator displays 22 are shown. In FIG. 6A, the player's status is indicated as "Active." The display 22 further indicates that the player's status is only in effect for a time period (e.g., five (5) more seconds), and that the player must place a wager within that time period in order to remain "active" status. In FIG. 6B, the player's status is indicated as "Inactive." The display 22 further indicates that the player must place a wager in order to become "active" status. Display 22 may be shown in a gaming device using separate display devices or may be shown occupying a portion of the main display of the gaming device.

Figure 7A:
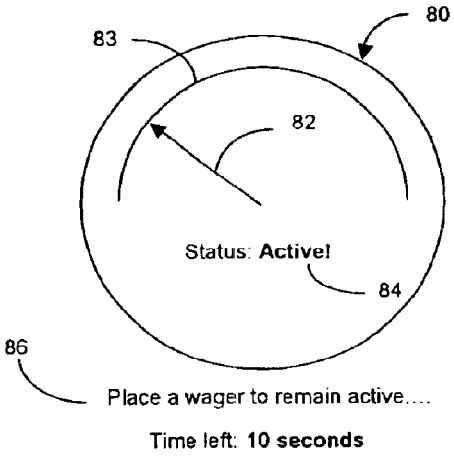
Figure 7B:
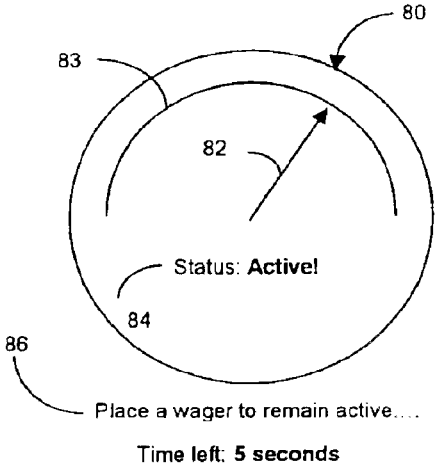
Figure 7C:
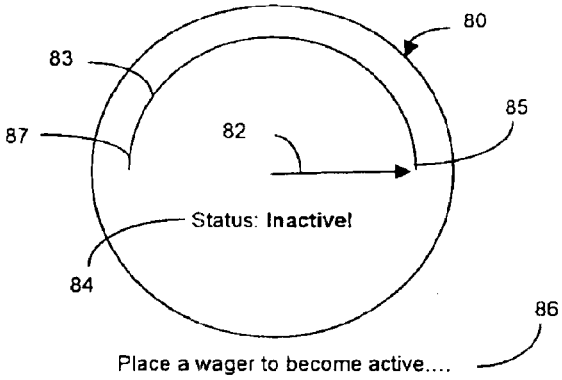

Referring now to FIGS. 7A through 7C, additional example status displays 80 representing analog gauges are shown. The gauges 80 may be physical analog devices controlled by the gaming device or may be a graphical representation of an analog display on a display device. The display 80 includes a movable needle 82 which rotates to define the active/inactive status of the player as well as the time period remaining for active status. Markings 83 define the time period remaining for active status as the needle sweeps from one end 87 to the inactive end 85. Text indicator 84 defines the player's status as either "active" (FIG. 7A and FIG. 7B) or "inactive" (FIG. 7C). Text indicator 86 further inform the player that the player's status is only in effect for a time period (e.g., 10 seconds in FIG. 7A, 5 seconds in FIG. 7B), and that the player must place a wager within that time period in order to remain "active" status. In FIG. 7C, the needle 82 rests in the inactive position when the status of the game/player is "inactive"; text indicator 86 further indicates that the player must place a wager in order to become "active" status.

Figure 4:
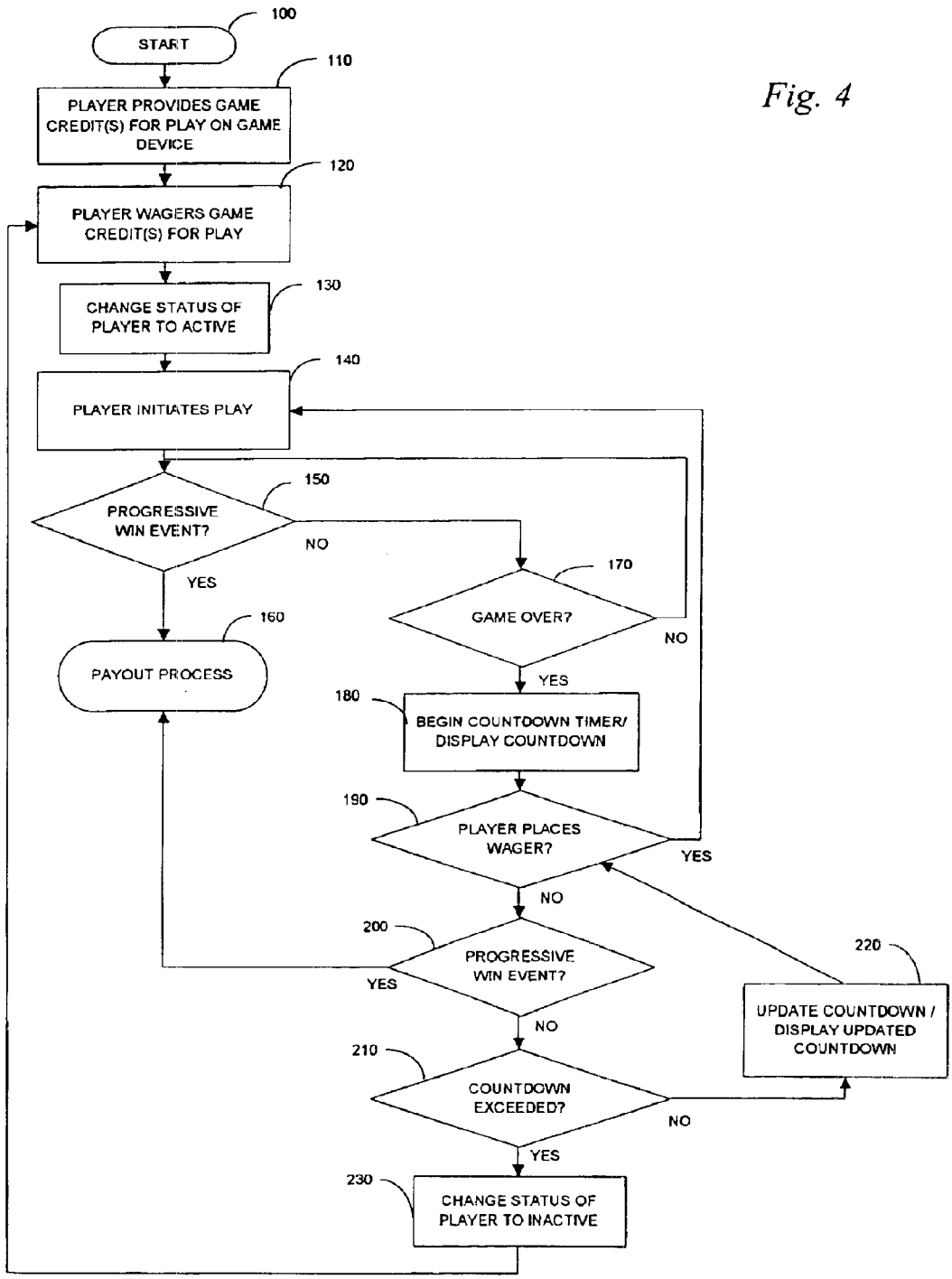
FIG. 4 is logical flow diagram depicting an example process for providing a primary and secondary progressive prize in accordance with the present invention.
Figure 5:
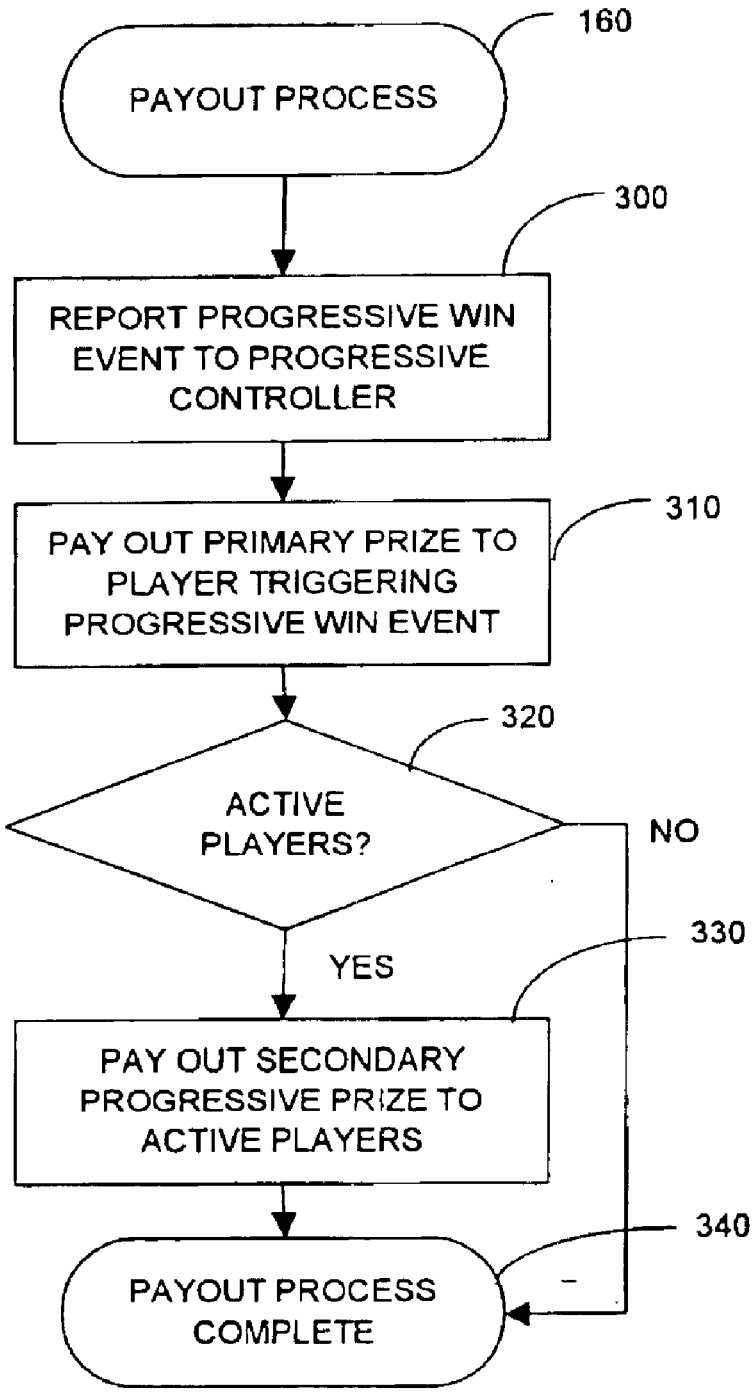
FIG. 5 is logical flow diagram depicting an example process for paying out a primary and secondary progressive prize in accordance with the present invention.

The method and operation of invention will be more fully understood with reference to the logical flow diagrams of FIG. 4 and FIG. 5, as well as FIG. 1 through FIG. 3, and FIG. 6 and FIG. 7. The order of actions as shown in FIG. 2 and FIG. 3 and described below is only illustrative, and should not be considered limiting.

FIG. 4 is a flow diagram showing an example process associated with providing a primary progressive prize and a shared progressive prize in accordance with the present invention. In this example process, the requirements for "active" status necessitates placing a predefined wager (e.g., at least one credit, maximum bet) within a time limit (e.g., within twenty (20) seconds from the conclusion of the previous game). As described above, various other criteria may be used to define "active" status and "inactive" status which are anticipated for use with present invention. This process starts at block 100 where a gaming device 10 is provided for play in a casino environment. Initially, the gaming device 10 initiates a player's state to "inactive." Thus the status display 22 will initially indicate the player's state as inactive.

At block 110, a player provides game credits for play on the gaming device 10. The game credits are normally credited to a credit meter and tracked by the gaming device 10 for use in placing wagers. Various means for providing game credits may be used such as through bill acceptors/coin acceptors; cashless devices (e.g., player accounts, ticket accounts, bank accounts), among others.

At block 120, the player wagers one or more credits for play on the gaming device 10. As described above in some embodiments, a percentage of the wager may be used to fund the local progressive prize (primary and/or shared secondary) and/or the WAC progressive prize 52 (primary and/or shared secondary). In other embodiments, the primary and/or shared progressive prizes (whether local or WAC) may be funded from expired prizes (e.g., points, prizes, coupons, etc).

Next at block 130, the player's status is changed to active if the requisite wager (e.g., at least one credit, maximum bet) is placed by the player at block 120. The status indicator 22 is also updated to reflect the player's "active" status. The gaming device 10 may communicate this change of status to the local controller 64 to update the player' status in the enrollment status database 78. Any countdown timers which are counting down are also reset/stopped until the game has concluded.

At block 140, the player initiates game play, normally by pressing a button or pulling a handle. The game of chance is then played in accordance with the rules of the game.

At decision block 150, a determination is made whether a progressive win event has occurred. As described above, the progressive win event may be conditioned upon play of the gaming device 10 or may be centrally determined (e.g., by the local controller 64). If a progressive win event has occurred, block 160 is carried and the payout process is initiated. This payout process is described more fully below in conjunction with FIG. 5. If a progressive win event does not occur during play of the gaming device, block 170 is then carried out.

At decision block 170, a determination is made whether the game of chance is over. If so, block 180 is then carried out. Otherwise, decision block 150 is repeated.

At block 190, the play of gaming device 10 has concluded. The countdown timer (e.g., example countdown timers of FIG. 6 and FIG. 7) is reset and started. As described above, the countdown timer may be used to indicate the time remaining before the player's status changes to "inactive." Associated text displays may be used to communicate what the player must do to remain active (e.g., place a wager).

At decision block 190, a determination is made whether the player places a wager. If the player places a wager, block 130 is then carried out to play the next game. If not block 200 is then carried out.

At decision block 200, a determination is made whether a progressive win event has occurred. For example, another player playing a different gaming device may trigger a progressive win event. Other events may be also be used for triggering the progressive win event as discussed above. If a progressive win event has occurred, the player is an active player and qualifies for the shared progressive prize. The payout process is then carried out at block 160 and as described more fully below in conjunction with FIG. 5. If a progressive win event has not occurred decision block 210 is then carried out.

At decision block 210, the enrollment module determines whether the countdown has been exceeded. If so, block 230 is then carried out. Otherwise block 220 is then carried out.

At block 220, the countdown has not been exceeded and the player's status remains "active." The countdown is updated and the updated countdown is displayed to the user. Block 190 then repeated.

At block 230, the countdown has been exceeded, and the player's status is changed to "inactive." The status display 22 is updated to reflect the change of status. Block 120 is then repeated when a player places a wager. The gaming device 10 may communicate this change of status to the local controller 64 to update the player' status in enrollment status database 78.

Referring now to FIG. 5, a logical flow diagram describing the payout process in accordance with the present invention is generally shown.

Block 160 is triggered from either block 150 or block 200 of FIG. 4. Upon the progressive win event occurring block 300 is carried out.

At block 300, the progressive win event is reported to the progressive controller. The communication is typically sent by the gaming device 10 on which the progressive win event occurs.

At block 310, the primary prize is paid to the player triggering the progressive win event. Normally this involves a casino attendant providing a "hand-pay" of the progressive amount to the player. "Hand-pay" for purposes of this application generally means the conventional understanding in the industry (e.g., completing the transaction away from gaming device between the player and a casino attendant and an exchange of documentation or forms).

At decision block 320, a determination is made whether there are any active players. This determination can be made from the enrollment status database 78 and/or by querying each of the gaming devices participating in the system. If there are any active players, block 330 is then carried out. In some cases there will always be an active player if the player triggering the progressive win event qualifies as an active player.

At block 330, the shared secondary prize is paid to each of the active players. If the shared secondary prize is in the form of credits or monies, the value may be directly credited to the meter of the gaming device 10. In other cases, the shared amount may be paid by the attendant as a "hand-pay." In the example embodiment where the player receives expired points, coupons, prizes, the player may be issued the points, coupons, prizes, etc. through vouchers or other account systems. The expiration for the newly issues points, coupons, prizes, etc. is reset for a new expiration term.

At block 340 the payout process is completed. The above process may be used to payout both local prizes as well as WAC prizes, whether primary or shared secondary.

As described above, the secondary progressive prize may be funded using expired (or expiring) prizes (coupons, points, game pieces, etc.). By way of illustration, an example embodiment using a simple point structure is described herein, although embodiments utilizing other formats (coupons, game pieces, vouchers, etc.) are suitable for use with the present invention.

The expired points arrangement provides that points may be accumulated and earned by a player during normal game play of a gaming device, that the points may expire after certain time periods and/or when other conditions are met, and that the expired points may be re-issued to players in the form of shared progressive awards. In some cases, the points may be awarded pursuant to criteria independent of play of the gaming device (e.g., free promotional points, comp points, etc.)

To illustrate the an example point system, consider a slot machine version of a gaming device, were one of the reel symbols is a "silver" prize. Depending on the number of "silver" prizes aligning on a wagered payline, a player is awarded a number of "silver" points. The points may be accumulated by the player and once a certain number are collected, the points may be exchanged for a "silver level" prize. The points may be accumulated, for example, through a database such as a points account system, a player account system, or anonymously through a ticket/voucher system tracking points. Other prize levels, such as "gold" and "platinum" could also be implemented in a similar manner.

The points may further have an expiration period, such as thirty (30) days from issuance, for example. As described above, a "prize expiration and reissue module" operating in a local controller device or other central server machine (e.g., a prize server) may be used to track points, including expiration. Once points expire, the points may be added to a pool of points available for payout as a shared progressive prize as described above (i.e., funding the progressive prize). Using the example "silver" prize from above, the progressive triggering event may be five (5) "silver" symbols aligning on a wagered payline with maximum bet. When the progressive win event occurs, the primary progressive prize may be awarded to the player playing the gaming device triggering the win event, while the accumulated "expired points" may be awarded (re-issued) to "active" players as the shared secondary progressive prize. Upon re-issuance of the points, the expiration period may be reset, establishing a new expiration period for the re-issued points. These points may also expire and be accumulated again into another shared secondary progressive prize. Under this arrangement, the system provides means for utilizing and awarding points which would otherwise have been expired and unused. In yet another alternative arrangement, the expired points may also be used to find the primary progressive prize as well as or instead of the secondary shared progressive prize.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A progressive system for paying out a primary progressive prize and a secondary progressive prize comprising:

a progressive controller including a controller processor and controller memory;

a progressive display coupled to said progressive controller;

funding module programming executed by said controller processor in said progressive controller, said funding module programming configured to maintain a primary progressive award and at least one secondary progressive award, said progressive display configured to display said primary progressive award and said at least one secondary progressive award and further configured to award said primary progressive award upon the occurrence of being notified of a win event and further using said notification of a win event for said primary progressive to determine a distribution of said at least one of said at least one secondary progressive award;

a plurality of game devices, each having a corresponding game processor and game memory;

a status indicator coupled to each said game device and useable to indicate said game device's current eligibility to participate in said at least one secondary progressive award;

a network connecting each said game device to said progressive controller and to provide for communication therebetween;

a game of chance executed by each said corresponding game device;

enrollment module programming executed by each said corresponding game device, said enrollment module programming configured to:

monitor said corresponding game device for a progressive winning event; maintain the status of said corresponding game device as to its eligibility to participate in at least one of said at least one secondary progressive award, said eligibility useable during said determining of a distribution;

indicate the game said maintained current eligibility status of said corresponding game device on said status indicator.

2. The progressive system of claim 1, wherein each said game device further comprises a base display, said status indicator occupying a portion of the base display.

3. The progressive system of claim 1, the progressive controller further configured to:

ascertain when a progressive winning event occurs on one of said game devices;

award said primary progressive award to the player of the game device on which a progressive winning event occurs; and award the entirety of said secondary progressive award between players of each of the game devices which have an active status when the progressive wining event occurs.

4. The progressive system of claim 1, wherein the primary progressive award and the secondary progressive award are funded from a percentage of wagers placed on the game devices.

5. The progressive system of claim 1, further comprising a prize server and a prize expiration and reissue module executed by the prize server, the prize expiration and reissue module configured to:

maintain expiring prizes issued by the game devices, said expiring prizes having an expiration period after issuance and constituting expired prizes after said expiration period; and fund the expired prizes to the secondary progressive award upon expiration of the expiration period.

6. The progressive system of claim 1, wherein said status indicator further comprises a countdown meter, said countdown meter indicating a period of time after which the state of the game status of the game device becomes inactive.

7. A method for providing a primary progressive prize and a secondary progressive prize in a gaming system having a progressive controller coupled for communication to a plurality of game devices, said method comprising:

maintaining a primary progressive award by the progressive controller;

maintaining at least one secondary progressive award by the progressive controller;

providing a progressive display coupled to the progressive controller;

displaying the primary progressive award and the secondary progressive award on the progressive display;

providing a status indicator usable to display current eligibility for said at least one secondary progressive award on each of the game devices;

maintaining the status of the game devices as to each game device's current eligibility for said at least one secondary progressive award;

indicating the status of each of the game devices on the status indicator as to each of said game devices' current eligibility for said at least one secondary progressive award; and using a win event for said primary progressive award to initiate some form of distribution of said secondary progressive award, said distribution using said maintained status of said game devices.

8. The method of claim 7, further comprising monitoring each of the game devices for a progressive winning event.

9. The method of claim 8, further comprising:

ascertaining when a progressive winning event occurs on one of the game devices;

awarding the primary progressive award to the player of the game device on which the progressive wining event occurs; and awarding the entire secondary progressive award between players of each of the game devices which have an active status when the progressive winning event occurs.

10. The method of claim 8, wherein the primary progressive award and the secondary progressive award are funded from a percentage of wagers placed on the game devices.

11. The method of claim 8, further comprising:

maintaining "expiring prizes" issued by the game devices, said expiring prizes having an expiration period after issuance and constituting expired prizes after said expiration period; and funding the expired prizes to the primary progressive award upon expiration of the expiration period.

12. The method of claim 8, further comprising:

maintaining "expiring prizes" issued by the game devices, said expiring prizes having an expiration period after issuance and constituting expired prizes after said expiration period; and funding the expired prizes to the secondary progressive award upon expiration of the expiration period.

13. The method of claim 8, wherein said status indicator further comprises a countdown meter, said method further comprising indicating, on the countdown meter, a period of time after which the state of the game status of the game device becomes inactive.

14. A method for funding a progressive award in a gaming system having a progressive controller coupled for communication to a plurality of game devices, said method comprising:

providing "expiring prizes" which may be issued by the game device pursuant to play thereon;

maintaining "expiring prizes" issued by the game devices, said expiring prizes having an expiration period after issuance and constituting expired prizes after said expiration period;

funding the expired prizes to at least one primary progressive award upon expiration of the expiration period; and awarding said at least one primary progressive award to a player of one of the game devices triggering a progressive winning event.

15. The method of claim 14, further comprising:

funding at least a portion of the expired prizes to at least one secondary progressive award; and awarding the secondary progressive award between players of each of the game devices which have an active status when the progressive winning event occurs.

16. The method of claim 14, further comprising:

providing a status indicator on each of the game devices; maintaining the status of the game devices; and indicating the status of each of the game devices on the status indicator.

17. A method for funding a progressive award in a gaming system having a progressive controller coupled for communication to a plurality of game devices, said method comprising:

providing "expiring prizes" which may be issued by the game device pursuant to play thereon;

maintaining "expiring prizes" issued by the game devices, said expiring prizes having an expiration period after issuance and constituting expired prizes after said expiration period;

funding a primary progressive award from a percentage of wagers placed on the game device;

funding the expired prizes to at least one secondary progressive award upon expiration of the expiration period;

awarding said at least one primary progressive award to a player of one of the game devices triggering a progressive winning event; and awarding the secondary progressive award between players of each of the game devices which have an active status when the progressive winning event occurs.

18. The method of claim 17 further comprising:

providing a status indicator on each of the game devices;

maintaining the game devices; and indicating the status of each of the game devices on the status indicator.

* * * * *